US006578480B1

(12) United States Patent
Konečný et al.

(10) Patent No.: US 6,578,480 B1
(45) Date of Patent: Jun. 17, 2003

(54) EQUIPMENT FOR DRIVING PLATE CYLINDERS OF A PRINTING MACHINE

(75) Inventors: Miloslav Konečný , Voděrady (CH); Václav Sedlák, Jedovnice (CH); Pavel Zourek, Sadová (CH)

(73) Assignee: Adamovske Strojirny, A.S., Adamov (CH)

( * ) Notice: Subject to any disclaimer, the term of this patent is extended or adjusted under 35 U.S.C. 154(b) by 0 days.

(21) Appl. No.: 09/914,620

(22) PCT Filed: Mar. 14, 2000

(86) PCT No.: PCT/CZ00/00018

§ 371 (c)(1),
(2), (4) Date: Oct. 15, 2001

(87) PCT Pub. No.: WO00/59728

PCT Pub. Date: Oct. 12, 2000

(30) Foreign Application Priority Data

Apr. 6, 1999 (CZ) ..... PV1186-99

(51) Int. Cl.[7] ..... B41J 13/20
(52) U.S. Cl. ..... 101/248; 101/485
(58) Field of Search ..... 101/248, 485, 101/480, 463.1

(56) References Cited

U.S. PATENT DOCUMENTS 3,746,957 A * 7/1973 Forster et al. ..... 318/696
5,092,242 A * 3/1992 Knauer ..... 101/248
5,651,314 A * 7/1997 Gentle ..... 101/248
5,771,805 A * 6/1998 Branas et al. ..... 101/248

FOREIGN PATENT DOCUMENTS

DE 197 23 147 A 12/1998
EP 1162064 A2 * 12/2001 ..... B41F/13/14
JP 04279347 A * 10/1992 ..... B41F/13/14

* cited by examiner

*Primary Examiner*—Daniel J. Colilla
(74) *Attorney, Agent, or Firm*—Blank Rome LLP

(57) ABSTRACT

For printing machines furnished with a Direct Imaging system for preparation of printing plates there is designed an equipment, comprising an auxiliary drive unit (23) coupled with the plate cylinder (1), which is coupled with the gear wheel assembly by disenagageable coupling means. In the preferred embodiment the plate cylinder (1) is at one end accommodated in a bearing (27) of a print unit side wall (4) by means of a carrier (3) which is axially shiftable seated at the neck (2) of the plate cylinder (1) and is in a direct engagement with the plate cylinder (1). The carrier (3) is further by means of a belt drive coupled with an auxiliary drive unit (23) and by an electrically operated clutch (7) with an output wheel (6) of the gear wheel assembly. In another preferred embodiment the plate cylinder (1) is furnished with a mechanism for angular displacement and a mechanism for axial shift.

4 Claims, 2 Drawing Sheets

EQUIPMENT FOR DRIVING PLATE CYLINDERS OF A PRINTING MACHINE

TECHNICAL FIELD

The invention relates to an equipment for driving plate cylinders of a printing machine furnished with a Direct Imaging system, the plate cylinders being coupled on the one hand with a central drive unit by means of a gear wheel assembly with disengageable coupling means and on the other hand with an auxiliary drive unit,

BACKGROUND OF THE INVENTION

There are known two methods of a digital procedure to prepare a printing plate for an offset printing machine.

The first technology procedure, which is the most applied method, is the computer-to-plate procedure, known as CTP system. The method is carried out outside the printing machine and applies an appropriate CTP equipment comprising an imaging unit and a rotating cylinder with affixed printing plate.

At a given moment the CTP equipment allows only for a single exposition of an image upon a single printing plate. For a print of a multicolour image it is necessary to consecutively expose all printing plates in individual colours for respective printing units and provide each plate with register slots. The completed printing plates are one by one clamped to respective plate cylinders of the printing machine.

The other digital technology is known as DI System, direct imaging procedure, applying laser beam for direct exposition of an image upon a printing plate still accommodated in the printing machine. The exposition is performed simultaneously on all printing units. Rotation of plate cylinders with affixed printing plates is controlled by a central driving unit. During the said procedure, apart from the respective plate cylinder, there are rotating all the cylinders, transport drums and all mechanisms operating during the printing process. A very important parameter for the printing machine with the DI system is the time period necessary for preparation of a new printing plate. The speed of an image transfer upon a printing plate depends on performance of the imaging equipment, namely upon number of spots exposed within a time unit and upon speed of rotation of a plate cylinder, which is driven by the central drive. Due to increased speed of the plate cylinder there are intensified vibrations of all rotating mechanisms of the printing machine. The high rate of vibrations has negative influence upon the quality of an image exposition on the printing plate. To eliminate this undesired feature the image exposition is performed by the plate cylinder speed lower than the one corresponding to the peak operation of the printing machine. The fact that all rotational parts are running during the preparation of printing plates adds to wear of the printing machine. Efforts to cut down the time period for the preparation of printing plates by installation of more powerful imaging equipment have resulted in cost being not proportional to the machine performance.

An equipment for a radial turning and axial shift of a plate cylinder, which is common by conventional printing machines, is not indispensable by machines equipped with the DI system, but application of the equipment helps the personnel to arrange the desired sheet register of colours. In a case the aid equipment is not available with the printing machine furnished with the DI system is not available, by any colour misregister there is necessary a correction of the image exposition to be provided for on a new printing plate.

The whole process to make a printing machine ready for a new print is therefore costly and needs a long time to be completed. By known printing machines the equipment for angular displacement is currently mounted at its one side, while the equipment for an axial shift is on the opposite side. Provided it is required to add another mechanism for controlling the plate cylinder, the fact, that both machine sides have been already "occupied", makes the machine redesign a very complicated affair.

From a paper DE-A-19723147 there is known an equipment for driving cylinders of a printing machine provided with the DI System, where the plate cylinders are coupled with a central drive unit by means of a gear wheel assembly to which the printing cylinder is coupled by disengageable coupling means and the equipment comprises.an auxiliary drive unit coupled with the plate cylinders. The said coupling means comprise a multi-position clutch and a metal-bellows clutch. Such an embodiment is complicated and needs mutual tuning of both clutches to achieve their proper co-operation and reliability of the whole system.

It is an object of the invention to eliminate the above drawbacks and facilitate preparations of new printing plates, especially for multicolour prints. It is a further object of the invention to facilitate adjustment of the register of individual colours.

DISCLOSURE AND OBJECT OF THE INVENTION

The foregoing problems are solved and the above objects are achieved by an equipment for driving plate cylinders of a printing machine, the plate cylinders being coupled on the one hand with a central drive unit by means of a gear wheel assembly with disengageable coupling means and on the other hand with an auxiliary drive unit, the equipment in an embodiment in accordance with the present invention comprising the plate cylinder, which is at one end accommodated in a bearing of a print unit side wall by means of a carrier which is axially shiftably seated at a neck of the plate cylinder and is in a direct engagement with the plate cylinder. The carrier is coupled with the auxiliary drive unit by means of a belt drive and with an output wheel of the gear wheel assembly by means of an electrically operated clutch, the clutch engaging with the output wheel and a driven pulley of the belt drive.

According to another aspect of the invention, the equipment comprises a mechanisms for angular displacement and a mechanism for axial shift, both mechanisms being coupled with the plate cylinder. According the first preferred embodiment of this aspect of the invention, the mechanism for angular displacement of the plate cylinder comprises an inner gear wheel swivelably seated on the carrier and coupled with an inner motor. The inner gear wheel is provided with a shoulder having an outer thread, which is screwed into an inner board attached in a constant distance to the side wall of the printing unit. Further in accordance with the second aspect of the invention the preferred embodiment of the mechanism for axial shift of the plate cylinder comprises outer gear wheel coupled with an outer motor. The outer gear wheel is in a swivel seat arranged on a rod rigidly attach to the plate cylinder neck. The outer gear wheel is provided with a shoulder, which is by means of its outer thread sewed into a hole in an outer board, spaced apart from the printing unit side wall at a fixed distance.

The new features provided by the invention comprise elimination of vibration of the rotating plate cylinder during direct imaging procedure of preparation of a printing plate, significant decrease of the time period of the procedure as there can be applied higher plate cylinder speed and there is also achieved a high extend of decrease of wear of rotational parts of the printing machine during the Direct Imaging procedure. It is also possible to prepare printing plates even for conventional printing machines of the size of the printing machine with the DI System.

According to other feature of the invention the compact design of the plate cylinder with the mechanisms for angular displacement and axial shift facilitates corrections of the register of individual colours. The single-sided arrangement of all the mechanisms according the invention makes the other side of the printing machine free for any other control accessories.

BRIEF DESCRIPTION OF THE DRAWINGS

By way of examples the invention will be now described with reference to the, accompanying drawings.

DESCRIPTION OF PREFERRED EMBODIMENTS

Figure 1:
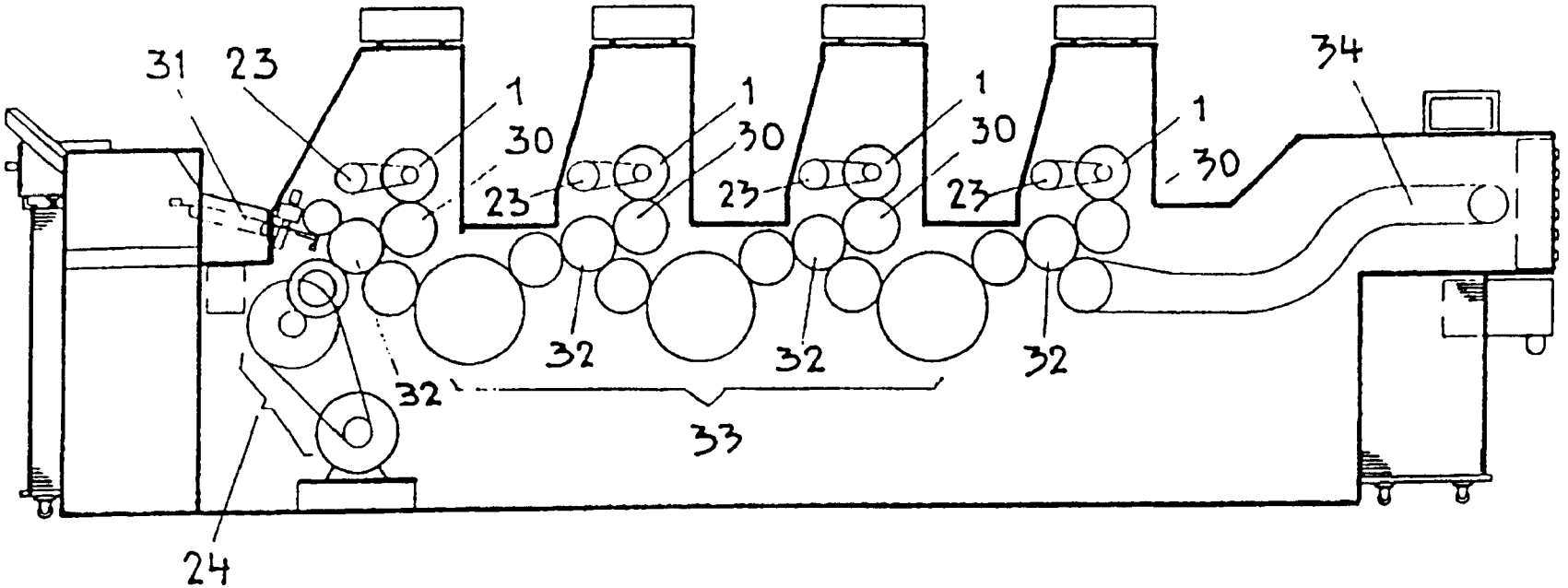
FIG. 1 is a side view of a four-colour printing machine, schematically illustrating arrangement of a central driving unit and the auxiliary drive unit.

Referring to FIG. 1, there is shown a fourcolour printing machine provided with a Direct Imaging System for preparation of printing plates. The machine has four printing units, each of them equipped with a separate plate cylinder 1 a blanket cylinder 30 and a press cylinder 32. Paper sheets are by a feeder table 31 brought to the press cylinder 32 of the first printing unit and then further on by means of a system of take-over and transfer cylinders 33 transported through other three printing units to the delivery table 34. All the plate cylinders 1 are driven by a central driving unit 24 and according to the invention each of them is furnished with a separate auxiliary drive unit 23.

Figure 2:
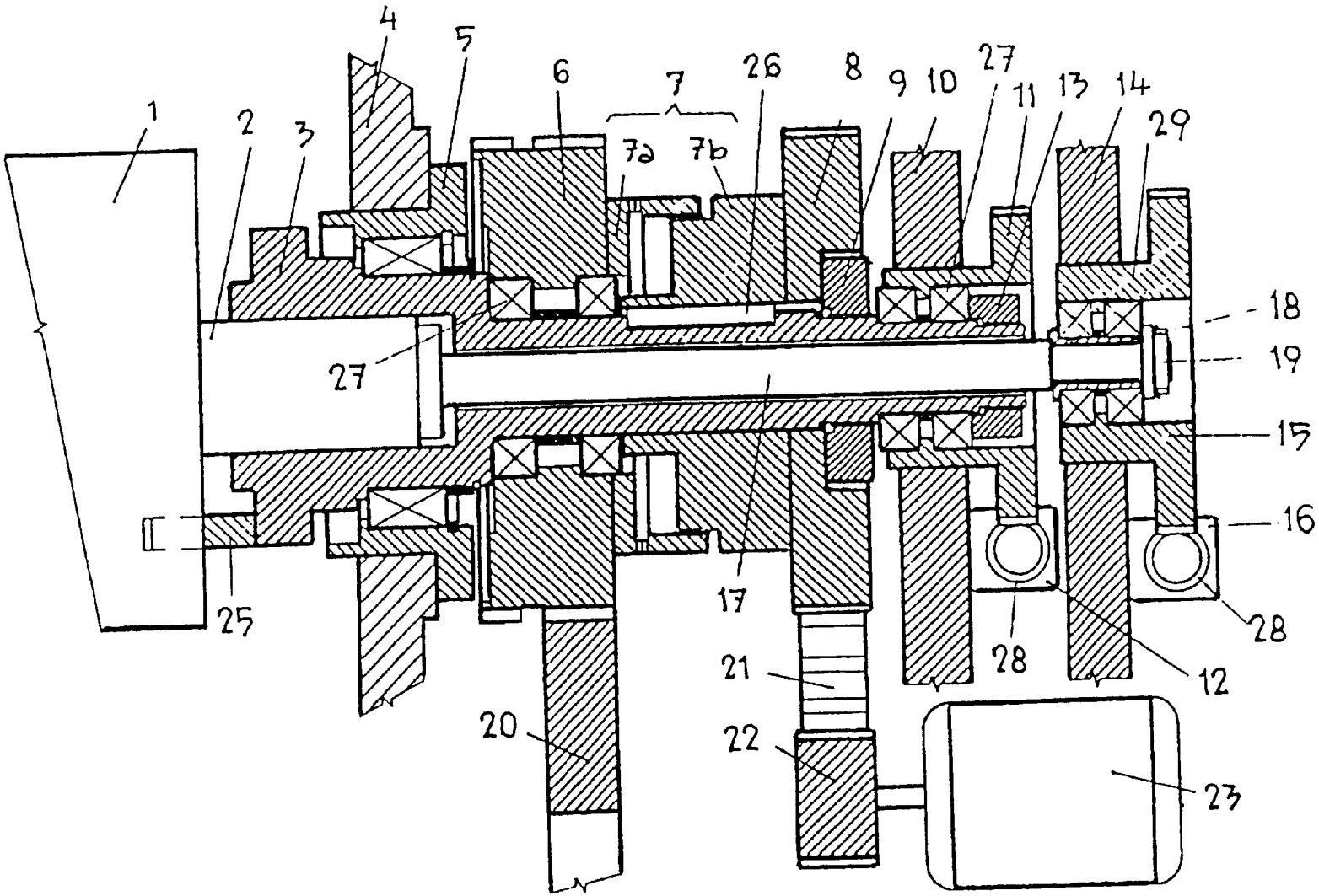
FIG. 2 presents a cross-section view of the preferred embodiment of the complete equipment according the invention.

As shown in FIG. 2 the plate cylinder 1 comprise a tube-like carrier 3, arranged co-axially and axially shiftably on one neck 2 of the cylinder. The carrier 3 engages with the plate cylinder 1 by means of an axially protruding arm 25. The carrier 3 is seated in a bearing 27 carried by a sleeve 5 attached in a side wall 4 of a printing unit. On the carrier 3, on a shoulder in the carrier middle part, there is located an output wheel 6 of the gear wheel assembly. The output wherein 6, seating on precise bearings 27, engages with a driving gear wheel 20 of the central drive. Both the output wheel 6 and the driving wheel 20 are furnished with helical spur gearing. The output wheel 6 is by means of disengageable coupling means coupled with the carrier 3. In the preferred embodiment the disengageable coupling means comprise an electrically controlled single-position clutch 7, the first part 7*a* of which is directly coupled with the output wheel 6, while its second part 7*b* is seated at the carrier 3 and radially secured by a torque 26. Simultaneously, the clutch second part 7*b* is by means of a belt drive coupled with the auxiliary drive unit 23. The belt drive comprise a driven pulley 8, seating upon the carrier 2, its axial position being secured by a fixing nut 9. The driving pulley 8 is by an indented belt 21, coupled with a driving pulley 22, which is attached upon a shaft of the auxiliary drive unit 23.

With a help of the neck 2 and the carrier 3 designed as described above, the plate cylinder 1 is further coupled with an equipment for angular displacement and another equipment for axial shift.

The equipment for angular displacement comprise an inner gear wheel 11, coupled with an inside motor 12. The inner gear wheel 11, engaging with a pinion 28 on the inner motor 12 shaft, is by means of bearings 27 swivelably located at the carrier 3. The radial position of the inner gear wheel 11 is secured by a fixing nut 13, screwed on the carrier 3 end. The inner gear wheel 11 is provided with a shoulder 29 having an outer thread, which is screwed into a hole in an inner board 10, which is spaced apart from the printing unit side wall 4 in a fixed distance by means of columns, not included at the drawing.

The mechanism for axial shift of the plate cylinder comprise outer gear wheel 15 and an outer motor 16. The outer gear wheel 15, engaging with a pinion 28 on the inner motor 12 shaft, is by means of bearings 27 swivelably seated on a tube-like insert 18 located at a shoulder 29 at the end of a rod 17, which projects through the hollow of the carrier 3 and is axially attached to the plate cylinder 1 neck 2. The axial position of the outer gear wheel 15 is fixed by an end nut 19 screwed at the end of the rod 17. The outer gear wheel 15 is provided with a shoulder having an outer thread, which is screwed into a hole in an outer board 14, which is attached in a fixed distance to the side wall 4 of the printing unit, outside the inner board 10, the distance being fixed by means of rigid columns, not included at the drawing. During the standard printing procedure the plate cylinder 1 is driven by the central driving unit 24, its power being transferred by means of the driving gear wheel 20 engaging by means of the output wheel 6 and the clutch 7 with the carrier 3. Simultaneously the auxiliary drive unit 23 is idly running as it is permanently coupled with the carrier 3 by means of the belt drive and the clutch 7 in engaged position.

For exposure of the plate cylinder 1 by the DI System, the clutch 7 is disengaged and therefore the output wheel 6 is uncoupled from the carrier 3. During the whole exposure procedure the plate cylinder 1 is driven by the auxiliary drive unit 23, the engagement of which with the carrier 3 remains untouched. The exposure procedure being completed there is again activated the clutch 7. Both clutch parts 7*a*,7*b* are re-coupled in the very same mutual position as previously, thus retaining the synchronization of the plate cylinders 1 and allow for the printing procedure to be started.

The equipment for angular displacement and the equipment for axial shift of the plate cylinder 1 are applied for adjustment of a sheet colour register. The angular displacement of the plate cylinder 1 is performed through angular turning of the inner gear wheel 12 by means of the inner motor 12. The rotation of the inner gear wheel 12 results in a angular displacement or fine turning of the carrier 3. The angular displacement of the carrier 3, due to the helical gearing of the output wheel 6 and the driving gear wheel 20, provides for the angular displacement of the output wheel 6 and thus for the angular displacement of the plate cylinder 1.

The axial shift of the plate cylinder 1 is carried out through turning of the outer gearwheel 15 by the outer motor 12. By means of the insert 18 and the rod 17 there is axially shifted the neck 2 and thus the plate cylinder 1 with respect to the carrier 3.

For a person skilled in the art it is obvious that the invention is not restricted only to the embodiment as described above.

INDUSTRIAL APPLICATIONS

The present invention is designed for printing machines with a Direct Imaging System for preparation of printing plates.

What is claimed is:

1. Equipment for driving plate cylinders of a printing machine furnished with a Direct Imaging System, the plate cylinders being coupled on the one hand with a central drive unit by means of a driving gear wheel assembly with disengageable coupling means and on the other hand with an auxiliary drive unit, characterised in, that the plate cylinder (1) is at one end accommodated in a bearing (27) of a print unit side wall (4) by means of a carrier (3) which is axially shiftably seated at a neck (2) of the plate cylinder (1) and is in a direct engagement with the plate cylinder (1), the carrier (3) being coupled with the auxiliary drive unit (23) by means of a belt drive and with an output wheel (6) of the gear wheel assembly by means of an electrically operated clutch (7), the clutch (7) engaging with the output wheel (6) and a driven pulley (8) of the belt drive.

2. Equipment according to claim 1, characterised in, each of the plate cylinders comprise a mechanism for angular displacement and a mechanism for axial shift.

3. Equipment according to claim 2, characterised in, that the mechanism for angular displacement of the plate cylinder (1) comprises an inner motor (12) coupled with an inner gear wheel (11), swivelably seating on the carrier (3) and having a shoulder with a thread on its outer surface being screwed into a hole in an inner board (10), the inner board (10) being spaced apart from the printing unit side wall (4) at a fixed distance.

4. Equipment according to claim 2, characterised in, that the mechanism for axial shift of the plate cylinder comprises an outer motor (16) coupled with an outer gear wheel (15) which is swivelably seated on a rod (17) projecting through the hole of the carrier (3) and being rigidly attached to the plate cylinder neck (2), the outer gear wheel (15) being provided with a shoulder with a thread on its outer surface being screwed into a hole in an outer board (10), spaced apart from the printing unit side wall (4) at a fixed distance.

* * * * *

UNITED STATES PATENT AND TRADEMARK OFFICE

CERTIFICATE OF CORRECTION

PATENT NO. : 6,578,480 B1 
DATED : June 17, 2003
INVENTOR(S) : Miloslav Konečný, Václav Sedlák and Pavel Zourek It is certified that error appears in the above-identified patent and that said Letters Patent is hereby corrected as shown below:

Title page,
Item [75], Inventors, change all inventors citizenship from Switzerland "(CH)" to Czech Republic -- (CZ) --.

Signed and Sealed this

Eighteenth Day of November, 2003

JAMES E. ROGAN
*Director of the United States Patent and Trademark Office*